US005092553A

United States Patent [19]

Joosse et al.

[11] Patent Number: 5,092,553

[45] Date of Patent: Mar. 3, 1992

[54] LIQUID-CONTAINER MOUNTING FOR FLOOR-TREATING MACHINERY

[75] Inventors: Timothy A. Joosse, Mount Pleasant; Wayne P. Vandehei, Oak Creek; John A. DalBesio, Racine, all of Wis.

[73] Assignee: S. C. Johnson & Son, Inc., Racine, Wis.

[21] Appl. No.: 675,370

[22] Filed: Mar. 25, 1991

[51] Int. Cl.[5] ..... A47K 1/08

[52] U.S. Cl. ..... 248/313; 24/339; 248/231

[58] Field of Search ..... 248/313, 314, 315, 316.1, 248/312, 311.2, 309, 231, 230, 231.1, 229; 24/339, 457, 458

[56] References Cited

U.S. PATENT DOCUMENTS

| | | | |
|---|---|---|---|
| 263,606 | 8/1982 | Smith . | |
| 377,526 | 2/1988 | Levy . | |
| 675,063 | 5/1901 | Kift | 248/313 |
| 688,230 | 12/1901 | Isgrig . | |
| 923,596 | 6/1909 | Staples . | |
| 947,282 | 1/1910 | Hall . | |
| 1,232,690 | 7/1917 | Keenan . | |
| 1,264,446 | 4/1918 | Sears | 248/231 X |
| 1,467,834 | 9/1923 | Bruch . | |
| 1,735,212 | 12/1929 | Pawsat . | |
| 1,774,775 | 9/1930 | Weitz . | |
| 1,780,308 | 11/1930 | Morris . | |
| 1,826,474 | 10/1931 | Kohler . | |
| 1,858,144 | 5/1932 | Fariello . | |
| 1,858,656 | 5/1932 | Batherman . | |
| 1,942,701 | 1/1934 | Hilton . | |
| 2,019,789 | 11/1935 | Mahannah . | |
| 2,416,828 | 3/1947 | Hamre . | |
| 2,452,116 | 10/1948 | Felton . | |
| 2,524,173 | 10/1950 | Peterson . | |
| 2,540,584 | 2/1951 | Jaycox . | |
| 2,638,297 | 5/1953 | Weinberger . | |
| 2,959,388 | 11/1960 | Fogle | 248/231 |
| 3,318,457 | 5/1967 | Krasnoff . | |
| 3,347,572 | 10/1967 | Pfaff, Jr. et al. | 248/231 X |
| 3,357,663 | 12/1967 | Ivy . | |
| 3,524,627 | 8/1970 | Boyanton . | |
| 3,765,635 | 10/1973 | Burrell et al. . | |
| 3,765,636 | 10/1973 | Burrell et al. . | |
| 3,854,687 | 12/1974 | Sick . | |
| 4,256,281 | 3/1981 | Harris et al. . | |
| 4,934,644 | 6/1990 | Nagy et al. | 248/231 |
| 4,957,251 | 9/1990 | Hubbard | 248/231 X |

*Primary Examiner*—Ramon O. Ramirez

[57] ABSTRACT

An improved mounting assembly is disclosed. The assembly is utilized in combination with floor-treating machinery structure (28 or 54 or 152). The mounting assembly comprises a U-shaped bracket (100), a threaded fastener (102), and a strap clamp (108). The U-shaped bracket (100) has tines (118) that are so spaced-apart and dimensioned relative to the liquid container cover (35) as to engagingly abut circumferential portions of the liquid container cover (35). The strap clamp (108) is of a length, relative to the circumference of the liquid container cover (35), that is sufficient for removably securing the liquid-container cover (35) to the U-shaped bracket (100).

2 Claims, 3 Drawing Sheets

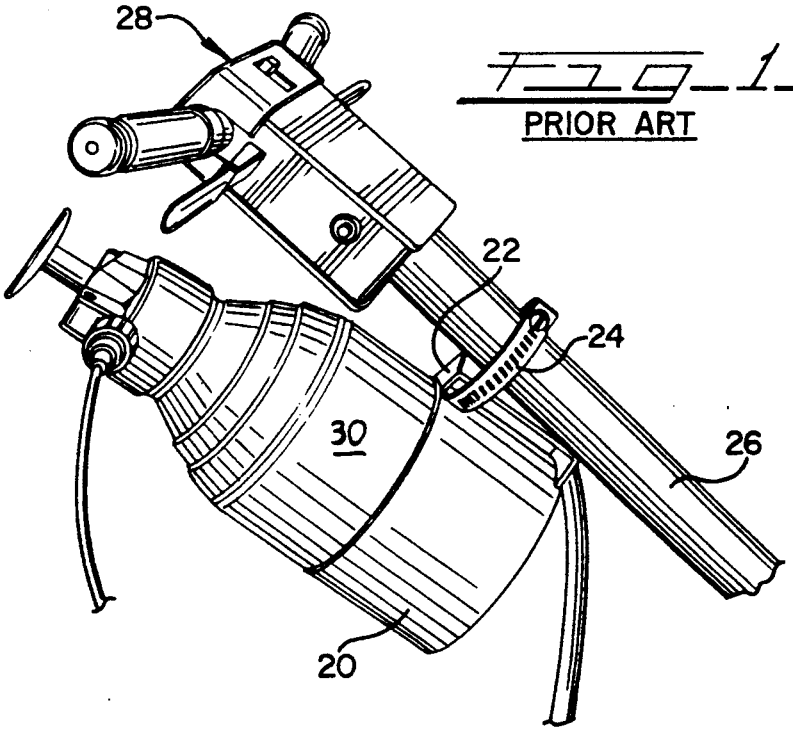
FIG. 1
PRIOR ART
FIG. 2
PRIOR ART
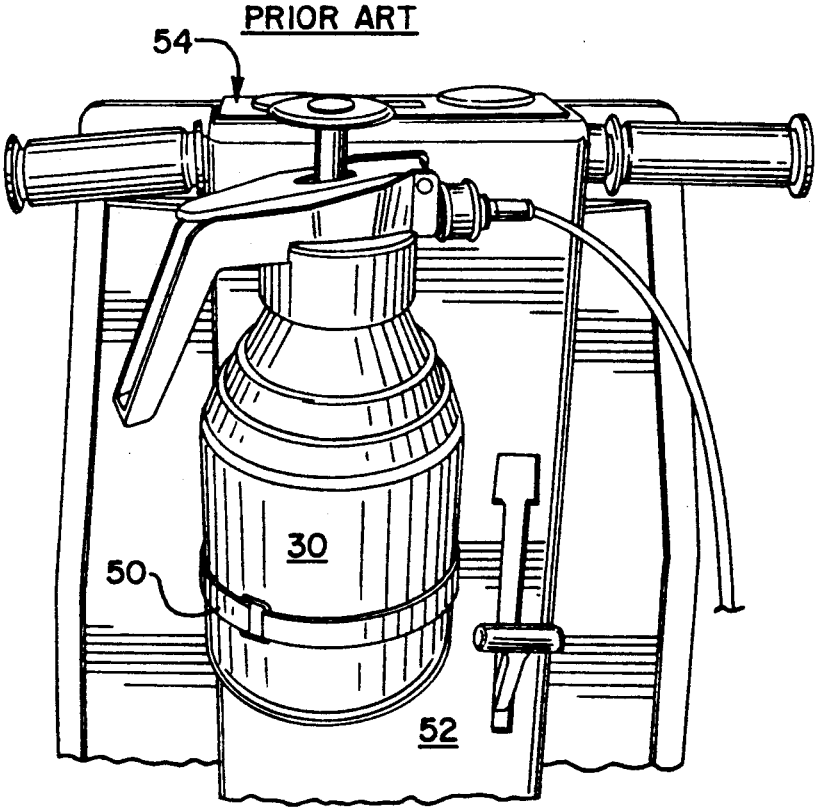

LIQUID-CONTAINER MOUNTING FOR FLOOR-TREATING MACHINERY

TECHNICAL FIELD

The present invention, in general, is directed to a device for mounting an article such as a liquid container to certain moveable structure. More particularly, the present invention is directed to an improved assembly for removably mounting liquid containers of various sizes and shapes to moveable, conventional floor-treating machinery.

BACKGROUND ART

A great many of the various known devices for mounting articles to structure are themselves rather specific in structure. For example, U.S. Pat. No. 923,596 to Staples discloses a device for mounting an umbrella to a chair or an easel. U.S. Pat. No. 947,282 to Hall discloses a device for mounting an umbrella to a canoe. U.S. Pat. No. 1,232,690 to Keenan discloses a device for mounting a nursing bottle to a chair or crib rail. U.S. Pat. No. 1,735,212 to Pawsat discloses a device for mounting a flashlight to a bicycle handlebar. U.S. Pat. No. 1,858,656 to Batherman discloses a device for mounting a blowtorch to a stepladder. U.S. Pat. No. 2,019,789 to Mahannah discloses a device for mounting a clamp to a bench top. Lastly, U.S. Pat. No. 2,540,584 to Jaycox discloses a device for mounting a fishing rod to a boat. Indeed, the rather specific structure of these various known mounting devices is dictated, at least in part, by certain desired objectives for each such mounted article as well as by that structure to which each such article is mounted.

For example, in certain situations, it is desirable to be able to removably mount a liquid container to moveable, conventional floor-treating machinery. In this regard, a number of mounting devices of this sort are presently commercially available. In particular, one such known mounting device includes a cup-shaped receptacle and a conventional so-called "strap" clamp. The opening of the cup-shaped receptacle can be so dimensioned as to enable the liquid container to be snugly retained therein. Such a cup-shaped receptacle may optionally further include a handle, so dimensioned relative to the "strap" clamp, as to enable the mounting of the receptacle handle to certain structure of the floor-treating machinery via the "strap" clamp. These kinds of liquid-container mounting devices pose certain problems, however. For example, another liquid container of different size or shape will necessarily require utilizing a receptacle having an opening of a size or shape that is complementary with the "other" container, for purposes of achieving desired snug-fit between liquid container and receptacle. Such a receptacle, unfortunately, may not always be available.

Another known mounting device utilizes a conventional tightenable belt, so dimensioned as to tightly encircle the liquid container, for purposes of securing the container to conventional floor-treating machinery. For example, certain structure of one such conventional floor-treating machinery may include slotted holes, so dimensioned as to enable the belt to be threaded therethrough. Or a mounting bracket, having slotted holes of this sort, may need to be secured to certain other structure of the floor-treating machinery, to achieve a like result. Use of conventional liquid-container mounting devices of these sorts, however, may tend to give rise to certain problems when it is desirable to replace an "empty" liquid container with a full one. In particular, a liquid container may, for example, contain 2 quarts of a particular fluid, or more, when full; and liquid-container replacement, if done too hurriedly, may give rise to undesired fluid spillage from a "full" liquid container. Also, the particular structure of mounting devices of these sorts tends to render slow and cumbersome the act of replacement of empty liquid containers with full ones.

Therefore, a general object of the present invention is to provide a structural assembly for removably mounting liquid containers of various sizes and shapes to moveable, conventional floor-treating machinery.

Another object is to provide specific mounting-device structure, for movably mounting such liquid containers to conventional floor-treating machinery, in a manner so as to permit replacement of empty liquid containers with full ones in significantly less time with significantly less bother, than is provided by conventional mounting-device structure.

A related object of the present invention is to provide specific mounting-device structure, which greatly reduces the likelihood of fluid spillage when it is desirable to replace an empty liquid container with a full one.

Additional objects, features and advantages of the present invention will readily become apparent to those skilled in the art, after reading the following.

SUMMARY DISCLOSURE OF INVENTION

The present invention is thus utilized in combination with certain liquid containers and as well as with certain structural elements of conventional floor-treating machinery. Such liquid containers can take a variety of shapes; but all such liquid containers that are contemplated in connection with the present invention typically have a generally circular opening at the top. All such liquid containers, furthermore, have a readily-removable cover. Such a cover, in particular, includes internal threads—either the so-called "conventional" threads or the so-called "bayonet"-type threads—, which are so dimensioned as to interfit with "mating" threads externally surrounding the opening of the liquid container.

Accordingly, one embodiment of the present invention includes (1) a generally U-shaped bracket, (2) threaded-fastener means for removably mounting the U-shaped bracket to floor-treating machinery structure, and (3) strap-clamp means of sufficient length relative to the circumference of the liquid container cover, for removably securing the liquid-container cover to the U-shaped bracket. A portion of the fastener means includes a threaded shank; and the U-shaped bracket and the machinery structure each have an opening or aperture, so dimensioned as to receive the threaded fastener shank. The U-shaped bracket is rotatable about the threaded fastener shank, relative to the machinery structure. The U-shaped bracket further includes a pair of spaced-apart tines having end-portions that are angled-away from each other. Each such tine includes, adjacent to its angled end portion, an elongated opening so dimensioned as to receive an end portion of the strap-clamp means, for purposes of removably affixing the strap-clamp means to the U-shaped bracket. The tines are, accordingly, so spaced-apart and dimensioned relative to the liquid container cover as to engagingly abut circumferential portions of the liquid container cover.

Another embodiment of the present invention includes (1) the above-discussed U-shaped bracket, (2) a generally L-shaped bracket, (3) threaded-fastener means, structurally identical to what is described above, for removably securing the U-shaped bracket to the L-shaped bracket, and (4) strap-clamp means. In the second embodiment, two strap clamps are utilized. In particular, one strap clamp is utilized, as discussed above, to removably secure the liquid-container cover to the U-shaped bracket. The L-shaped bracket includes a pair of spaced-apart elongated openings or slits, each so dimensioned as to receive an end portion of the "other" strap clamp, for purposes of utilizing the "other" strap-clamp means to removably mount the L-shaped bracket onto floor-treating machinery structure. The L-shaped bracket also has an opening or aperture, spaced in distal relation to the slits, for receiving the threaded shank of the threaded-fastener means. When assembled, the U-shaped bracket is rotatable about the threaded fastener shank, relative to the L-shaped bracket.

INDUSTRIAL APPLICABILITY

There are a wide assortment of different types of conventional floor-treating machines, each performing specific functions. There are, for example, certain commercially-available floor-treating machines that "pretreat" or "prime" a floor, for purposes of enabling a surface coating to readily subsequently be applied to the floor. Also, there are still other types of commercially-available floor-treating machines that are used exclusively to apply surface coatings to floors. Additional conventional floor-treating machines include the so-called "burnishers", which are used to polish a floor. Still other commercially-available floor-treating machinery includes machines which are utilized to remove surface coatings from a floor.

The industrial applicability of the present invention is in combination with certain structural elements of such floor-treating machinery as is briefly mentioned above, which requires a particular liquid or fluid, for purposes of achieving a particular desired floor-treatment result.

In this regard, the industrial applicability of the present invention is also in combination with liquid containers, of the size and shape briefly mentioned above, which contain such floor-treatment liquids and fluids as floor "coatings", floor-coating "strippers", floor "polishes", and so forth.

BRIEF DESCRIPTION OF THE DRAWINGS

The accompanying drawing figures will now briefly be summarized.

FIG. 1 is a partially-fragmented perspective view of a prior-art assembly for mounting a conventional liquid container to a structural element of a conventional floor-treating machine.

FIG. 2 is a partially-fragmented perspective view of another prior-art assembly for mounting the conventional liquid container to a different structural element of yet another type of floor-treating machine.

Throughout the several drawing figures, like reference numerals refer to like elements and/or components.

BEST MODE FOR CARRYING OUT THE INVENTION

Figure 3:
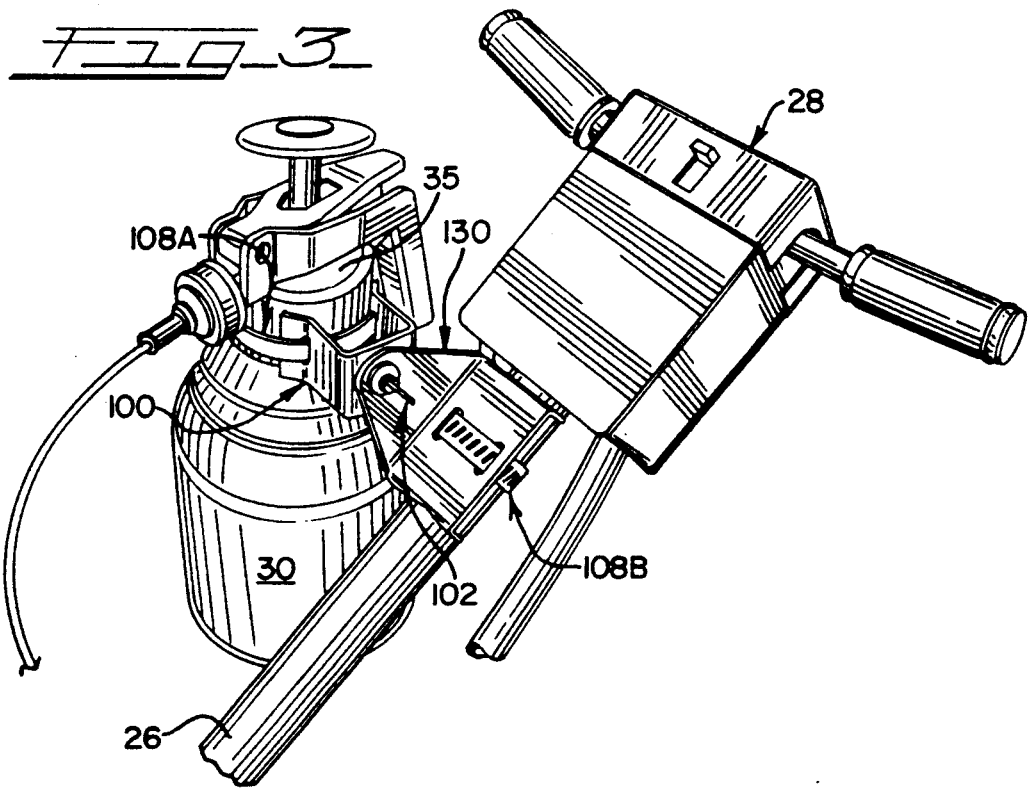
FIG. 3 is a partially-fragmented perspective view of the second embodiment of the improved assembly of the present invention, removably secured to structure of one type of conventional floor-treating machinery.

Directing the reader's attention to FIGS. 1 and 2, the prior-art assemblies will now briefly be discussed.

In FIG. 1, for example, there is shown a conventional cup-shaped receptacle 20. Receptacle 20 includes an integral handle 22, which defines an opening of size sufficient to enable a conventional strap clamp 24 to be utilized to secure the receptacle handle 22 to a structural element 26 of one type of conventional floor-treating machine 28.

The cup-shaped receptacle 20 (FIG. 1) is so dimensioned relative to a conventional liquid container 30 as to enable the liquid container 30 to be snugly received into the opening of receptacle 20.

In FIG. 2 there is shown a conventional tightenable belt 50, so dimensioned relative to liquid container 30 as to tightly encircle liquid container 30, for purposes of securing liquid container 30 to a structural element 52 of another type of conventional floor-treating machine 54.

Although the following details are not presently shown, those skilled in the art are well aware that structural element 52 might include slotted holes, so dimensioned relative to belt 50 as to enable belt 50 to be threaded therethrough, for purposes of utilizing belt 50 to secure liquid container 30 to structural element 52 of the illustrated floor-treating machine 54.

Figure 6:
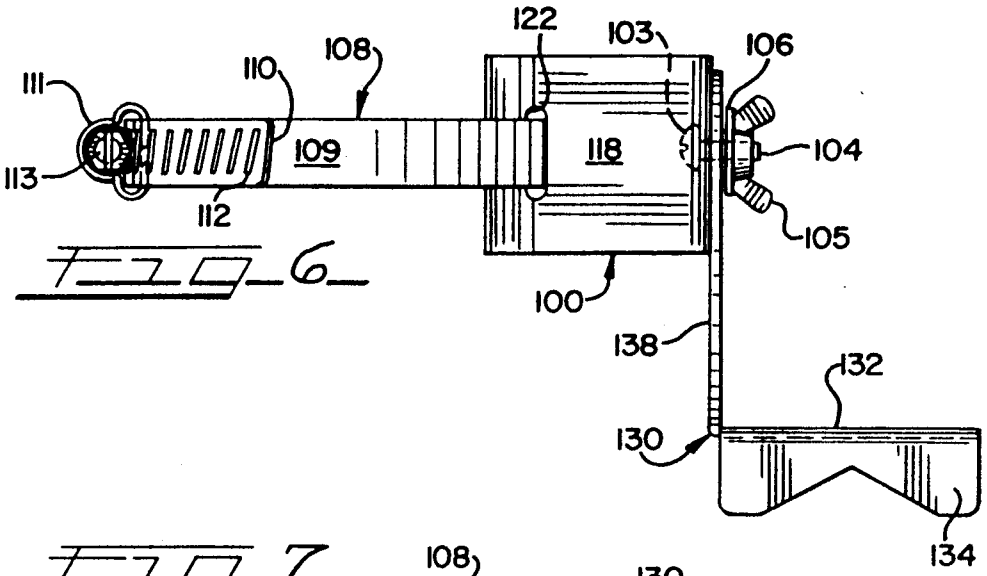
FIG. 6 is a side elevational view, on an enlarged scale relative to FIGS. 3 and 4, presenting all of the elements of the improved assembly of the first embodiment as well as a majority of the elements of the improved assembly of the second embodiment.
Figure 7:
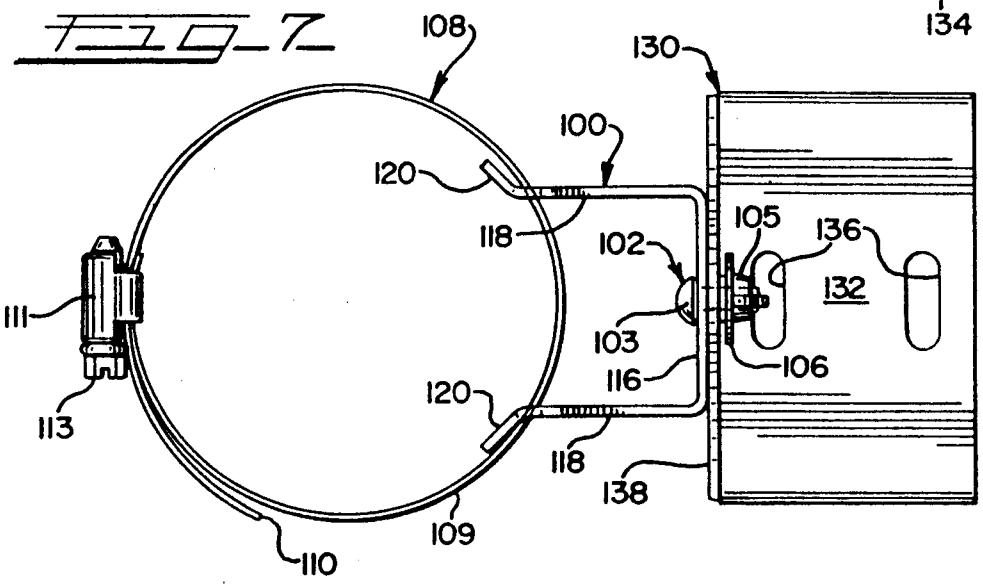
FIG. 7 is a top plan view of the improved assembly shown in FIG. 6.
Figure 5:
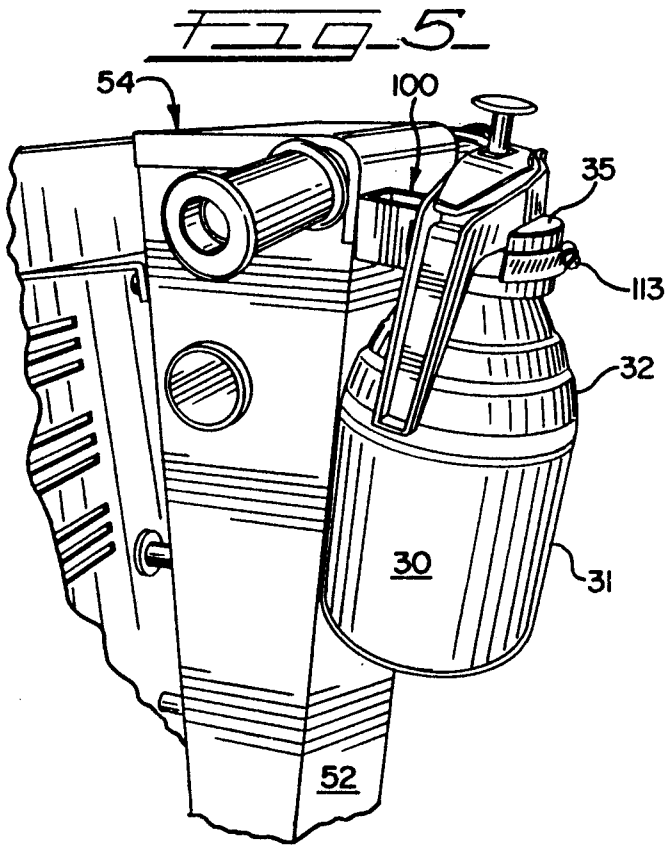
FIG. 5 is a partially-fragmented perspective view of the first embodiment of the improved assembly of the present invention, removably secured to structure of still another type of conventional floor-treating machinery.

Those skilled in the art are also well aware, in the event that structural element 52 does not include slotted holes, that belt 50 might itself alternatively need to be secured to a mounting bracket (also not shown) having similarly slotted holes, and that such a mounting bracket might accordingly itself need to be affixed to structural element 52, to achieve a result similar to the result discussed above. Referring to FIGS. 5 through 7, the first embodiment of the improved assembly of the present invention will now be discussed.

The conventional floor-treating machine 54 shown in FIG. 5 was briefly discussed above in connection with FIG. 2. The conventional liquid container 30, also shown in FIG. 5, was briefly discussed above in connection with FIGS. 1 and 2.

The illustrated liquid container 30 is preferably sized to contain about 2 quarts of a particular floor-treating liquid. The lower portion 31 of the illustrated liquid container 30 is generally cylindrical in shape; and the upper portion 32 of liquid container 30 is generally conical in shape, with the container opening (not shown) being at the top of the container upper portion 32. The container opening is circular. Peripherally surrounding the circular container opening are conventional unitary screw threads (also not shown).

Conventional container 30 includes a cap or cover 35 having unitary internal threads which are so dimensioned as to mate with the external threads surrounding the container opening.

The improved mounting assembly of the present invention is preferably utilized to removably secure a conventional liquid container to a conventional floor-treating machine. (Please refer, for example, to FIG. 5.)

In this regard, reference is next invited to FIGS. 6 and 7, for purposes of discussing the first embodiment of the improved mounting assembly of the present invention.

The first embodiment of the improved mounting assembly comprises: (1) a generally U-shaped bracket 100, (2) conventional threaded-fastener means 102 for movably mounting the U-shaped bracket 100 to floor-treating machinery structure, and (3) conventional strap-clamp means 108 of sufficient length, for removably securing a liquid container cover or lid to the U-shaped bracket 100.

The illustrated conventional threaded fastener 102 includes: a slotted head 103; a threaded shank 104, unitary with head 103; and a wing nut 105, internally threaded to mesh with the threads of fastener shank 104. If desired, the threaded fastener means 102 may further include at least one washer 106, as is illustrated in FIGS. 6 and 7.

The illustrated conventional strap-clamp means includes a metal band 109 having a free end 110 and a conventional threaded mechanism 111 affixed to the opposite end portion of metal band 109. The metal band 109 further includes a plurality of elongated slotted holes or slits 112, so aligned along the length of the metal band 109, starting at the free end 110 of metal band 109, and so mutually spaced apart, as to mesh with the screw threads (FIG. 7) of the conventional threaded mechanism 111. The threaded mechanism includes a tensioning screw 113. To form a ring, the slits 112 adjacent to the free end 110 of metal band 109 are engaged with the threads (FIG. 7) of the threaded mechanism 111, and the tensioning screw 113 is utilized in a conventional manner so as to cause the free end 110 of the metal band 109 to be drawn through the threaded mechanism 111. The tensioning screw 113 is thus utilized to provide a ring of desired dimension. Screw 113 can also be utilized to increase or decrease the tension in band 109 (whenever the band is encircling a liquid container cover), as desired.

A wide assortment of conventional strap clamps can thus be utilized to provide a variety of rings of predetermined diameter, for purposes of removably securing a conventional liquid-container cover or lid (of like diameter) to the U-shaped bracket 100.

The U-shaped bracket includes a base portion 116 (FIG. 7) and a pair of spaced-apart tines 118 which are unitary with base 116. The tines 118 include end portions 120 (FIG. 7) that are angled away from each other. In particular, the tine end portions 120 are so mutually angled as to abuttingly engaged exterior circumferential portions of a great many of the various-sized conventional liquid-container covers, typically utilized in combination with the various types of conventional floor-treating machinery mentioned above.

The base 116 of U-shaped bracket 100 further includes an opening or hole (not shown), for securing the U-shaped bracket 100 directly to a structural element 52 of the floor-treating machine 54, as shown in FIG. 5, if desired. Such an opening or hole is preferably centrally located on base portion 116, as is indicated in FIGS. 6 and 7. Also preferably, such a hole or opening is so dimensioned as to readily receive the threaded shank 104 of the threaded-fastener means 102 discussed above.

Further in reference to U-shaped bracket 100, it will be noted that each such tine 118 includes, adjacent to its angled end portion 120, an elongated opening 122 (FIG. 6) so dimensioned as to readily receive the free-end 110 of the conventional strap clamp 108. In particular, before the metal band 109 of the strap clamp 108 is formed into a ring, the free end 110 of the strap clamp 108 is passed through the opening 122 of each such tine 118, and then the metal band 109 is next formed into a ring (in the manner described above), for purposes of removably affixing the conventional strap clamp 108 to the U-shaped bracket 100.

With the first embodiment of the improved mounting assembly thus affixed to the illustrated conventional floor-treating machine 54 (FIG. 5), tensioning screw 113 of the conventional strap clamp can be adjusted to removably affix a conventional liquid container to the machine 54. Because the strap clamp is tensioned around the liquid container cover 35 only, the replacement of an "empty" liquid container with a "full" liquid container merely requires turning (i.e., rotating) the now-empty liquid container 30, relative to the liquid container cover 35, to disengage the container 30 from the cover 35. Replacing an "empty" liquid container with a "full" one, therefore, merely requires reversing the above-described procedure, replacing the "empty" container with a "full" container.

Replacing liquid containers in this manner has shown itself to be less messy and more time-efficient, than would otherwise be achievable, utilizing conventional mounting assemblies.

Figure 4:
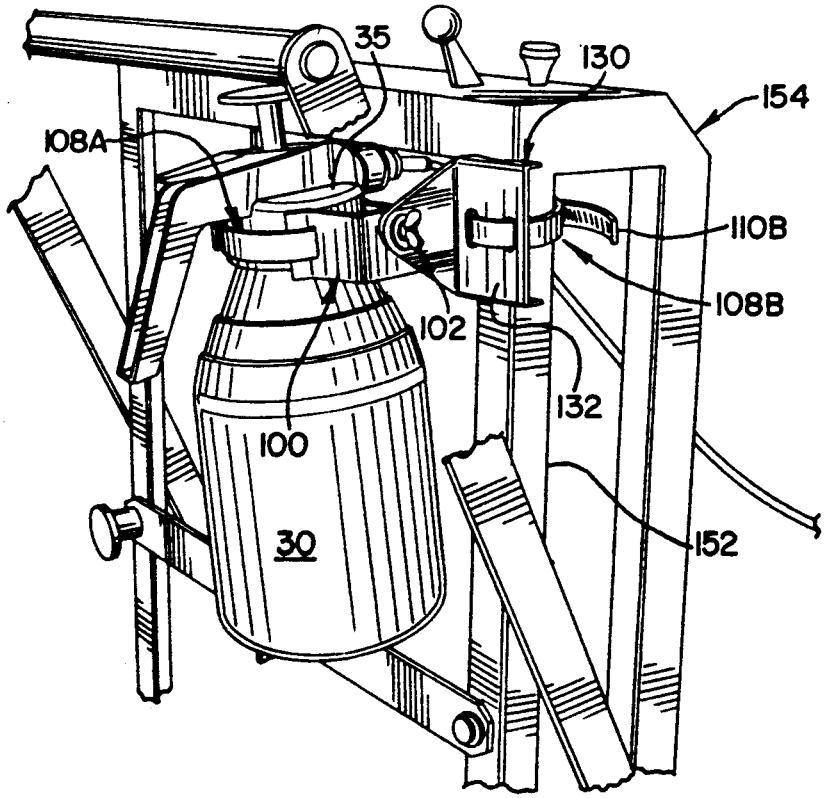
FIG. 4 is also a partially-fragmented perspective view of the second embodiment of the improved assembly of the present invention, removably secured to structure of another type of conventional floor-treating machinery.

Directing the reader's attention to FIGS. 3 and 4 in conjunction with FIGS. 6 and 7, the second embodiment of the improved mounting assembly of the present invention will now be discussed.

As was briefly mentioned above, the second embodiment of the improved mounting assembly includes the above-discussed U-shaped bracket 100 and threaded-fastener means 102. The second embodiment, however, further includes a generally L-shaped bracket 130.

L-shaped bracket 130 includes a base portion 132 (FIGS. 6 and 7) a spaced-apart pair of notched gripping portions 134 (one of which is shown in the foreground in FIG. 6), that are unitary with base 132 and which are preferably disposed at right angles to base 132. Base portion 132 includes a spaced-apart pair of elongated holes or slits 136 (FIG. 7), each of which is disposed transverse to the "grips" 134 and on opposite sides of the inverted V-notch of grips 134. (Please refer to FIGS. 6 and 7.) The slits 136 are so dimensioned as to receive the free end 110 of strap clamp 108, as will be discussed in greater detail below. L-shaped bracket 130 further includes mounting portion 138 (FIG. 6) which is unitary with base 132 and preferably disposed at a right angle thereto, in the opposite direction of the grips 134. Mount 138 includes a hole, located in distal relation to the slits 136 of base 132, and so dimensioned as to receive the threaded fastener shank 104 (discussed above), whereby one skilled in the art is able to utilize threaded-fastener means 102 to removably secure U-shaped bracket 100 to L-shaped bracket 130. (Please refer to FIGS. 6 and 7.)

The second embodiment of the improved mounting assembly of the present invention further includes strap-clamp means. In the second embodiment, two strap-clamps are utilized. In particular, one strap clamp 108A is utilized, as discussed above, to removably secure the liquid-container cover 35 to the U-shaped bracket 100. (Please refer to FIGS. 3 and 4.) The other strap clamp 108B, before being formed into a ring, has its free end 100B (FIG. 4) passed first through the slits 136 (FIG. 7) of base 132 of the L-shaped bracket 130, and thereafter around a structural member 152 of still another type of conventional floor-treating machinery 154, for purposes of removably-securing the liquid container 30 to the machinery 154. (Please refer to FIG. 4.)

With the liquid container 30 thus secured to the U-shaped bracket 100 via the first strap clamp 108A and with the L-shaped bracket 130 thus secured to structural member 152 via the second strap clamp 108B, the threaded fastener 102 is utilized to removably join the U-shaped bracket 100 and the L-shaped bracket 130 together, in the manner described above. In the second embodiment of the improved mounting assembly of the present invention, because the U-shaped bracket 100 is rotatable about the threaded fastener shank 104 relative to the mounting portion 138 of the L-shaped bracket 130, the threaded fastener 102 can be used to removably secure liquid container 30, in a generally upright manner, relative to most conventional floor-treating machinery 28 or 154. (Please refer to FIGS. 3 or 4.) This particular feature has been found to minimize fluid spillage when it is desirable to replace an "empty" liquid container with a full one.

What has been illustrated and described herein is an improved mounting assembly. While the improved mounting assembly of the present invention has been illustrated and described with reference to two preferred embodiments, it is to be understood that the present invention is not to be limited to these particular embodiments. On the contrary, structural alternatives, changes and modifications will become apparent to those skilled in the art upon reading the foregoing description. Accordingly such alternatives, changes and modifications are to be considered as forming a part of the present invention insofar as they fall within the spirit and scope of the accompanying claims.

What is claimed is:

1. In combination with floor-treating machinery and a liquid container cover, an assembly for rotatably, removably mounting a liquid container onto floor-treating machinery structure, comprising:

a U-shaped bracket having tines that are so spaced-apart and dimensioned relative to the liquid container cover as to engagingly abut circumferential portions of the liquid container cover;

threaded-fastener means carried by the floor-treating machinery for rotatably, removably mounting the U-shaped bracket onto the floor-treating machinery structure, the fastener means including a shank defining a longitudinal axis, about which longitudinal axis the U-shaped bracket is rotatable relative to the floor-treating machinery structure; and strap-clamp means carried by the U-shaped bracket and of a length, relative to the circumference of the liquid container cover, that is sufficient for removably securing the liquid-container cover to the U-shaped bracket.

2. In combination with floor-treating machinery and a liquid container cover, an assembly for removably mounting a liquid container to floor-treating machinery structure, comprising:

a U-shaped bracket having tines that are so spaced-apart and dimensioned relative to the liquid container cover as to engagingly abut circumferential portions of the liquid container cover;

a unitary L-shaped bracket having a base portion and a mounting portion that is disposed transverse to the base portion; first strap-clamp means carried by the floor-treating machinery, for removably mounting the base portion of the L-shaped bracket to the floor-treating machinery structure; threaded-fastener means carried by the L-shaped bracket, for removably mounting the U-shaped bracket onto the mounting portion of the L-shaped bracket, the fastener means proving a shank about which the U-shaped bracket is rotatable relative to the floor-treating machinery structure; and second strap-clamp means carried by the U-shaped bracket and of a length, relative to the circumference of the liquid container cover, that is sufficient for removably securing the liquid-container cover to the U-shaped bracket.

* * * * *